US010850530B2

(12) United States Patent
Otis, Jr. et al.

(10) Patent No.: US 10,850,530 B2
(45) Date of Patent: Dec. 1, 2020

(54) PRINTHEAD LIQUID DELIVERY AND GAS REMOVAL

(71) Applicant: Hewlett-Packard Development Company, L.P., Houston, TX (US)

(72) Inventors: David Ridgway Otis, Jr., Corvallis, OR (US); Si-lam Julius Choy, Corvallis, OR (US); Kevin Edward Swier, Corvallis, OR (US); David N. Olsen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 331 days.

(21) Appl. No.: 15/748,714

(22) PCT Filed: Oct. 27, 2015

(86) PCT No.: PCT/US2015/057585
§ 371 (c)(1),
(2) Date: Jan. 30, 2018

(87) PCT Pub. No.: WO2017/074314
PCT Pub. Date: May 4, 2017

(65) Prior Publication Data

US 2020/0079101 A1 Mar. 12, 2020

(51) Int. Cl.
*B41J 2/19* (2006.01)
*B41J 2/165* (2006.01)
*B41J 2/175* (2006.01)

(52) U.S. Cl.
CPC ..... *B41J 2/19* (2013.01); *B41J 2/165* (2013.01); *B41J 2/17563* (2013.01); *B41J 2/17596* (2013.01); *B41J 2002/16502* (2013.01)

(58) Field of Classification Search
CPC . B41J 2/175; B41J 2/17596; B41J 2/18; B41J 2/19; B41J 2202/07
See application file for complete search history.

(56) References Cited

U.S. PATENT DOCUMENTS 4,734,711 A * 3/1988 Piatt ..... B41J 2/175 137/12
4,940,995 A 7/1990 Hine et al.
(Continued)

FOREIGN PATENT DOCUMENTS

| | | |
|---|---|---|
| JP | 2007125776 | 5/2007 |
| JP | 2010030206 | 2/2010 |
| WO | WO-2006120048 | 11/2006 |

OTHER PUBLICATIONS

Diagraph Corp., Diagraph Ink Delivery System Stand-Alone (IDS/SA), 5802-677, Rev. D, St. Louis / Earth City, MO, Feb. 19, 2001, 35 pages.

*Primary Examiner* — John Zimmermann
(74) *Attorney, Agent, or Firm* — Dierker & Kavanaugh PC

(57) ABSTRACT

In one example, a liquid delivery and gas removal system for a printhead. The system includes a pump to provide a liquid at a positive pressure. The system also includes a filter fluidically coupled to the pump to receive the pressurized liquid at an upstream side, at a first pressure push the liquid through the filter to a downstream side, and at a higher second pressure push gas bubbles in the liquid through the filter to the downstream side. The system further includes a vent having a gas-permeable membrane. A wet side of the membrane is fluidically coupled to the downstream side and to a printhead. A vacuum is applied to a dry side of the membrane.

15 Claims, 6 Drawing Sheets

(56) References Cited

U.S. PATENT DOCUMENTS

| | | | | |
|---|---|---|---|---|
| 4,961,082 | A | 10/1990 | Hoisington et al. | |
| 4,971,527 | A * | 11/1990 | Dick | B41J 2/17596 137/115.27 |
| 5,341,162 | A | 8/1994 | Hermanson et al. | |
| 5,808,643 | A | 9/1998 | Tracy et al. | |
| 5,841,454 | A | 11/1998 | Hall et al. | |
| 5,936,650 | A | 8/1999 | Ouchida et al. | |
| 6,755,500 | B2 | 6/2004 | Hirano et al. | |
| 6,840,603 | B2 | 1/2005 | Barinaga et al. | |
| 7,040,745 | B2 | 5/2006 | Kent | |
| 7,118,206 | B1 | 10/2006 | Stockwell et al. | |
| 7,481,521 | B2 | 1/2009 | Takemoto | |
| 7,669,990 | B2 * | 3/2010 | Murakami | B41J 2/18 347/84 |
| 8,235,514 | B2 | 8/2012 | Murray | |
| 8,469,503 | B2 | 6/2013 | Price et al. | |
| 2005/0275679 | A1 | 12/2005 | Childs et al. | |
| 2006/0114298 | A1 * | 6/2006 | Anderson, Jr. | B41J 2/17513 347/85 |
| 2007/0052782 | A1 | 3/2007 | Lee | |
| 2011/0267406 | A1 | 11/2011 | Hanson | |
| 2012/0026255 | A1 * | 2/2012 | Park | B41J 2/175 347/85 |
| 2012/0050358 | A1 | 3/2012 | Kitabatake | |
| 2013/0233418 | A1 | 9/2013 | Aldrich | |
| 2013/0314465 | A1 | 11/2013 | Lebron et al. | |
| 2014/0300668 | A1 | 10/2014 | Chang et al. | |
| 2015/0091992 | A1 | 4/2015 | Kopp et al. | |
| 2017/0197426 | A1 * | 7/2017 | Nagai | B41J 2/18 |
| 2017/0203578 | A1 * | 7/2017 | Choy | B41J 2/17563 |
| 2017/0368835 | A1 | 12/2017 | Otis et al. | |

* cited by examiner

600

PRINTHEAD LIQUID DELIVERY AND GAS REMOVAL

BACKGROUND

Many printers and printing systems controllably eject small droplets of at least one liquid onto a print medium to form printed output. In some cases, a liquid is ink, but in others it is another type of liquid. By delivering the liquid to the liquid ejection elements within a well-controlled pressure range over a wide range of liquid flow rates and environmental conditions, a desired level of print quality can be achieved.

DETAILED DESCRIPTION

Figure 1:
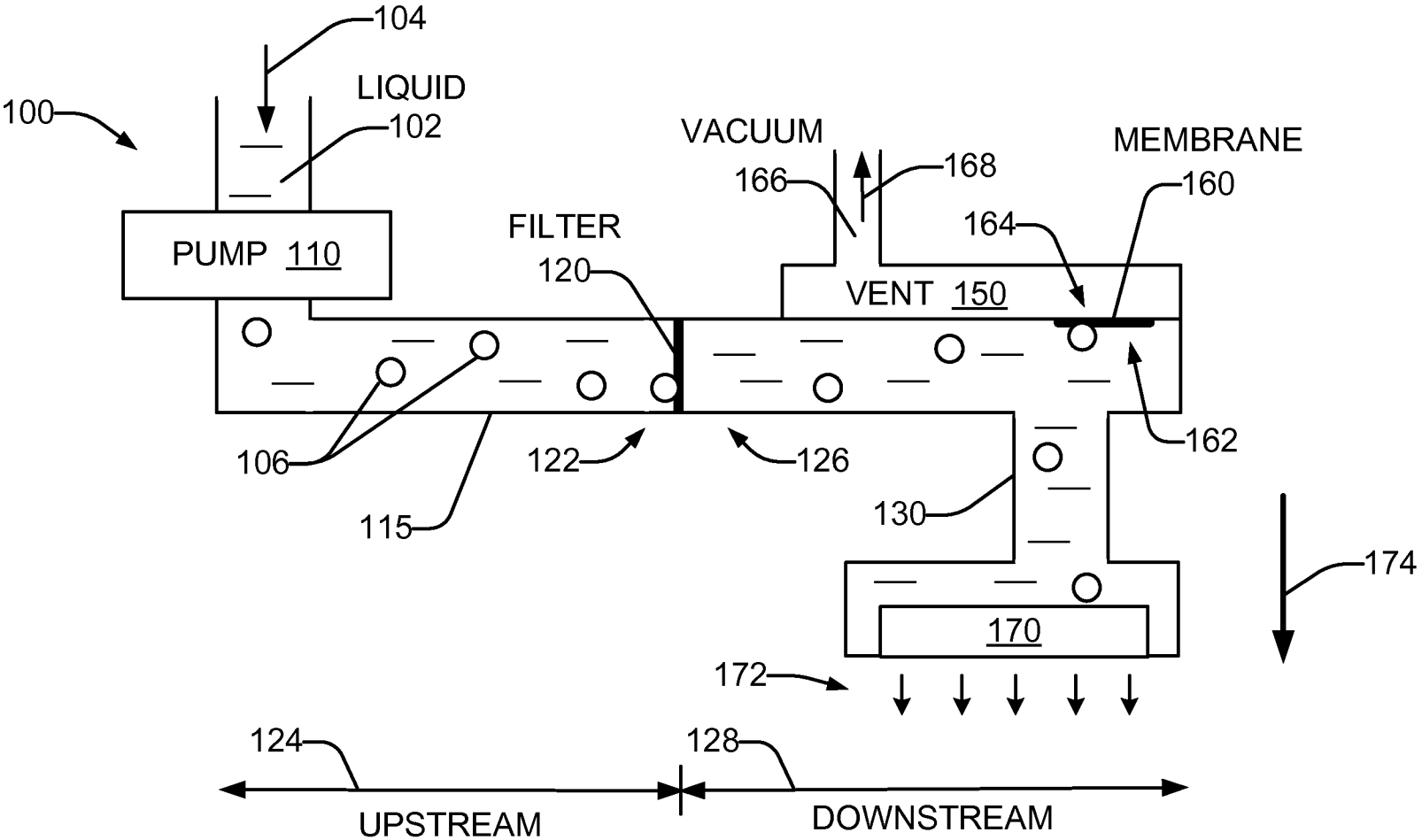
FIG. 1 is a schematic representation of a liquid delivery system for a printhead in accordance with an example of the present disclosure.
Figure 2A:
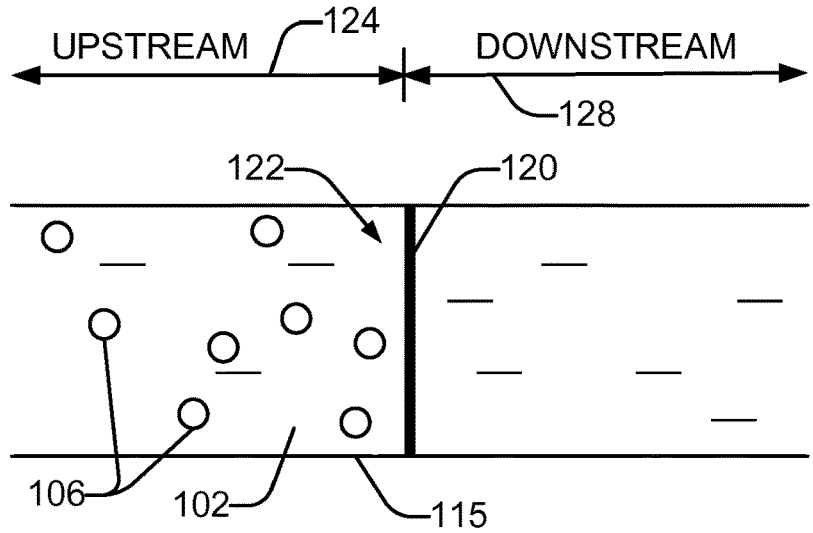
FIGS. 2A through 2D are schematic representations of pushing gas bubbles in a liquid through a filter usable with the system of FIG. 1 in accordance with an example of the present disclosure.
Figure 2B:
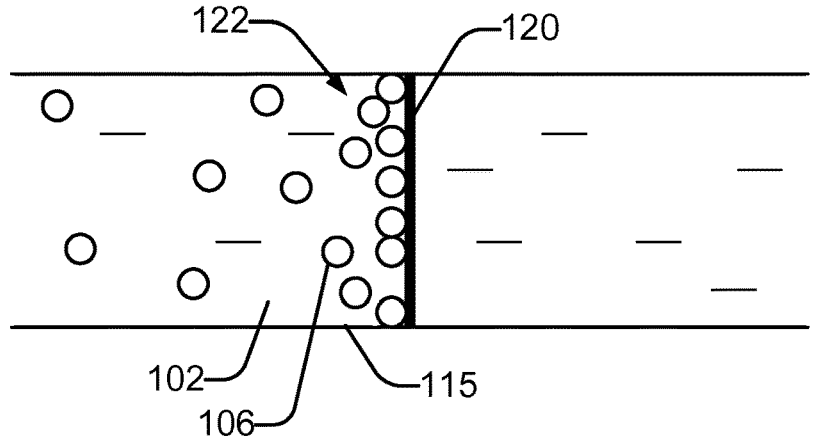
Figure 2C:
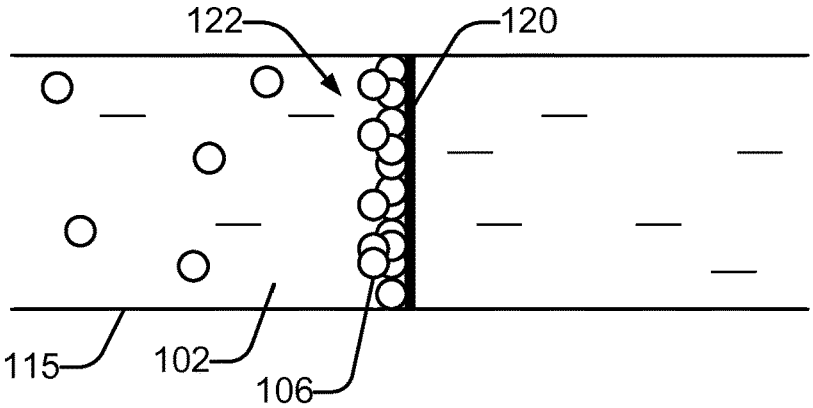
Figure 2D:
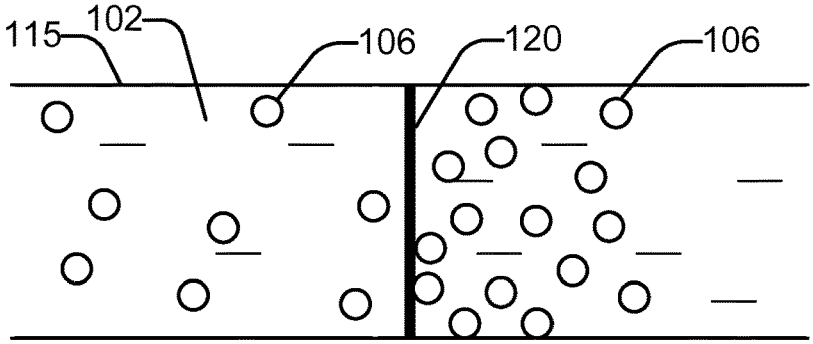

Gas bubbles, such as air, may be present along with the liquid in the liquid flow paths of printer or printing system. Gas bubbles may arise, and/or grow in, the flow paths and conduits by diffusion in from the outside, outgassing, entry at fluid interconnects, entrance through nozzles, and/or via other mechanisms.

These gas bubbles can degrade or prevent proper delivery of the liquid to the liquid ejection elements of printheads. This, in turn, can degrade or prevent proper ejection of the liquid from the ejection elements and/or proper deposition of the ejected liquid drops onto the print medium. Doing so can undesirably decrease the quality of the printed output. For example, where the liquid is ink, the image quality of the printed output can be degraded such that the printed output does not appear as it was intended to.

In order to reduce or prevent these problems, it is desirable to remove the gas bubbles from the liquid flow paths.

Referring now to the drawings, there is illustrated an example of a liquid delivery system for a printhead which removes gas bubbles from the liquid flow paths. A pump pressurizes a liquid and pushes the liquid, and gas bubbles in the liquid, through a filter. These gas bubbles, in addition to gas bubbles originated at the liquid ejection elements or at other points in the liquid flow path, are pulled via vacuum through a vent having a gas-permeable membrane.

Considering now a liquid delivery system for a printhead, and with further reference to FIG. 1, a liquid delivery system 100 includes a pump 110, a filter 120, and a vent 150 having a membrane 160. The pump 110 provides a liquid 102 at a positive pressure to the filter 120 through a conduit 115. The liquid 102 flows in a direction 104. In some examples, liquid 102 includes gas bubbles 106 therein. The gas bubbles 106 may be of varying sizes. In some examples, the gas bubbles are air bubbles. The filter 120 removes impurities from the liquid 102. The filter 120 divides the system 100 into an upstream portion 124 and a downstream portion 128, and thus the filter 120 has an upstream side 122 and a downstream side 126. The pump 110 and conduit 115 are located upstream 122 of the filter 120.

The pump 110 generates a variable positive pressure in the conduit 115 which urges the liquid 102 and the gas bubbles 106 through the filter 120 to the downstream portion 128. The filter 120 is structured such that liquid is pushed through, or passes through, the filter 120 to the downstream side 126 at a first pressure. The pressure drop across the filter 120 ($\Delta P_{filter}$) scales linearly with the viscosity (Viscosity) and flow rate (VolumetricFlowRate) of the liquid 102, and inversely with the area (Area) available for liquid flow. As the filter 120 becomes increasingly obstructed with gas bubbles 106, the area available for liquid flow decreases, and so the trans-filter pressure for a given liquid flow rate increases. The pressure-flow relationship may be expressed as:

$$\Delta p_{filter} = EmpiricalConst \times \text{Viscosity}\left(\frac{VolumetricFlowRate}{Area}\right).$$

As is discussed subsequently in greater detail with reference to FIGS. 2A-2D, gas bubbles 106 are pushed through, or pass through, the filter 120 to the downstream side 126 at a second pressure that is higher than the first pressure. This second pressure, known as the bubble pressure ($P_{bub}$), is generally proportional to the surface tension (SurfTens) of the liquid 102, and inversely proportional to the largest pore size ($R_{pore}$) in the filter 120:

$$p_{bub} = \frac{2 * SurfTens \times \cos(ContactAngle)}{R_{pore}}$$

For example, at a ContactAngle of 20 degrees and a SurfTens of 33 dyne/cm, the bubble pressure $P_{bub}$ is 155,049 dyne/cm$^2$, or 62.2 inches of water.

The downstream portion 128 has a fluidic enclosure 130 for the liquid 102 and gas bubbles 106. In some examples, the fluidic enclosure 130 includes at least one manifold, channel, conduit, cavity, chamber, and/or the like. In examples, the enclosure 130 contains the liquid in free space within the enclosure 130, without the use of a liquid absorber, such as foam. The vent 150 is coupled to the fluidic enclosure 130 by the vent membrane 160. The vent membrane 160 has a wet side 162 which is in contact with the interior of the fluidic enclosure 130, and a dry side 164 which is in contact with the interior of the vent 150. Within a predetermined range of pressures in the fluidic enclosure 130, and for predetermined types of liquids, the vent membrane 160 is gas-permeable but not liquid-permeable. As a result, and as is discussed subsequently with reference to FIG. 3, under proper differential pressure conditions gas bubbles 106 in the downstream portion 128 readily pass through the membrane 160 but liquid 102 does not. A vacuum 166 applied to the dry side 164 of the membrane 160 pulls gas bubbles 106 in the fluidic enclosure 130 collected at the membrane 160 through the membrane 160, and vents them in the direction 168.

A printhead 170 is also fluidically coupled to the fluidic enclosure 130 of the liquid delivery system 100. The printhead 170 has plural liquid ejection elements which can controllably eject or emit drops 172 of the liquid through nozzles onto a print medium (not shown) disposed adjacent the printhead 170. In some cases, additional gas bubbles 106 may enter the fluidic enclosure 130 through the printhead nozzles or via other mechanisms or at other places on the downstream side 128. These additional gas bubbles 106 can also collect at, and be pulled through, the vent membrane 160 and thus removed from the fluidic enclosure 130 via the vent 150. The additional gas bubbles 106 may result from outgassing which occurs when gas-saturated liquid is heated. They can also grow by diffusion, where a partial pressure gradient drives gas into the system. Gas can also enter the nozzles via a "shock" event in which a gas bubble is "gulped" into the ink delivery system.

In some examples, the system 100 is arranged such that the printhead 170 is at a lower portion of the fluidic enclosure 130, with the printhead nozzles disposed such that liquid drops are ejected substantially downward, in the direction 174 of gravity. In some examples, the vent 150 is disposed at an upper portion or position of the fluidic enclosure 130, such that the gas bubbles 106 tend to rise due to buoyancy toward, and/or collect at, the vent membrane 160 for removal. In some examples, the vent membrane 160 is disposed substantially horizontally, so as to maximize the surface area for contact by rising gas bubbles 106.

In some examples, the vacuum 166 can affect the pressure in the fluidic enclosure 130 when gas bubbles 106 are being drawn through the membrane 160. Once the gas bubbles 106 have been drawn through the membrane 160, a pressure regulator, such as for example pressure regulator 480 (FIG. 4), can maintain a negative gage pressure (or "back pressure") with respect to atmosphere. Doing so can inhibit the liquid from "drooling" from the nozzles and/or inhibit outside air from entering the fluidic enclosure 130 and forming additional gas bubbles 106.

In some examples, the vacuum 166 is continuously applied to the dry side 164 of the membrane 160 The vacuum 166 can be continuously applied when the system 100 is printing, when the system 100 is powered on but not printing, and/or when the system 100 is powered off.

In some examples, the vent 150 is the only vent in the liquid delivery system 100. In some examples, there is no vent disposed upstream of the filter 120

Considering now in further detail a filter of a fluid delivery system, and with further reference to FIGS. 2A through 2D, one example of the filter 120 includes pores (or capillaries) with a maximum pore size on the order of 5 to 10 microns in diameter. The liquid 102 is pushed through the pores by the pressure exerted in the liquid 102 by the pump 110 (FIG. 1). In the absence of gas bubbles 106 at the upstream side 122 of the filter 120, as in FIG. 2A at time T1, the liquid 102 has access to all the surface area of the upstream side 122, and the liquid 102 is pushed through the filter 120 to the downstream side of the ink delivery system under a pressure of, in one example, two inches of water. However, gas bubbles 106 tend to accumulate on the upstream side 122 of the filter 120, as in FIG. 2B at time T2, rather than pass through the filter 120. The accumulation of bubbles reduces the amount of the surface area of the upstream side 122 in contact with the liquid 102. Although bubbles 106 that come into contact with each other are illustrated for clarity in FIGS. 2B-2C as individual bubbles, contacting bubbles 106 may merge into fewer, larger bubbles. Due to the operation of the pump 110, the pressure in the upstream conduit 115 increases as the area available for liquid flow is reduced as more gas bubbles 106 block pores of the filter 120. As more gas bubbles 106 accumulate at the upstream side 122 of the filter 120, as in FIG. 2C at time T3, the pressure continues to rise until a point at which the viscous pressure drop across the filter 120 reaches a pressure greater than or equal to that required to drive a gas bubble 106 through the filter 120 (the "bubble pressure"). In one example, the bubble pressure is between 40-80 inches of water. When the bubble pressure is reached or exceeded, as in FIG. 2D at time T3, at least some of the gas bubbles 106 pass through the filter 120, reducing the pressure in the ink conduit 115. This occurs intermittently during operation, depending on the volume of gas in the system and the duty cycle of the pump 110. Depending on the type of pump 110 used (e.g. diaphragm or peristaltic) and the type of pressure control system employed (e.g. pressure limit valves or active control with sensors), the pump 110 may turn off when a limiting pressure is reached, or the pump may continue to cycle and recirculate the liquid 102. In some examples, the filter 120 is vertically positioned such that buoyancy collects the gas bubbles 106 against the filter 120, and promotes the passage of all the collected gas bubbles 106 at one time. In other examples, the filter 120 has a different orientation within the liquid delivery system.

Figure 3:
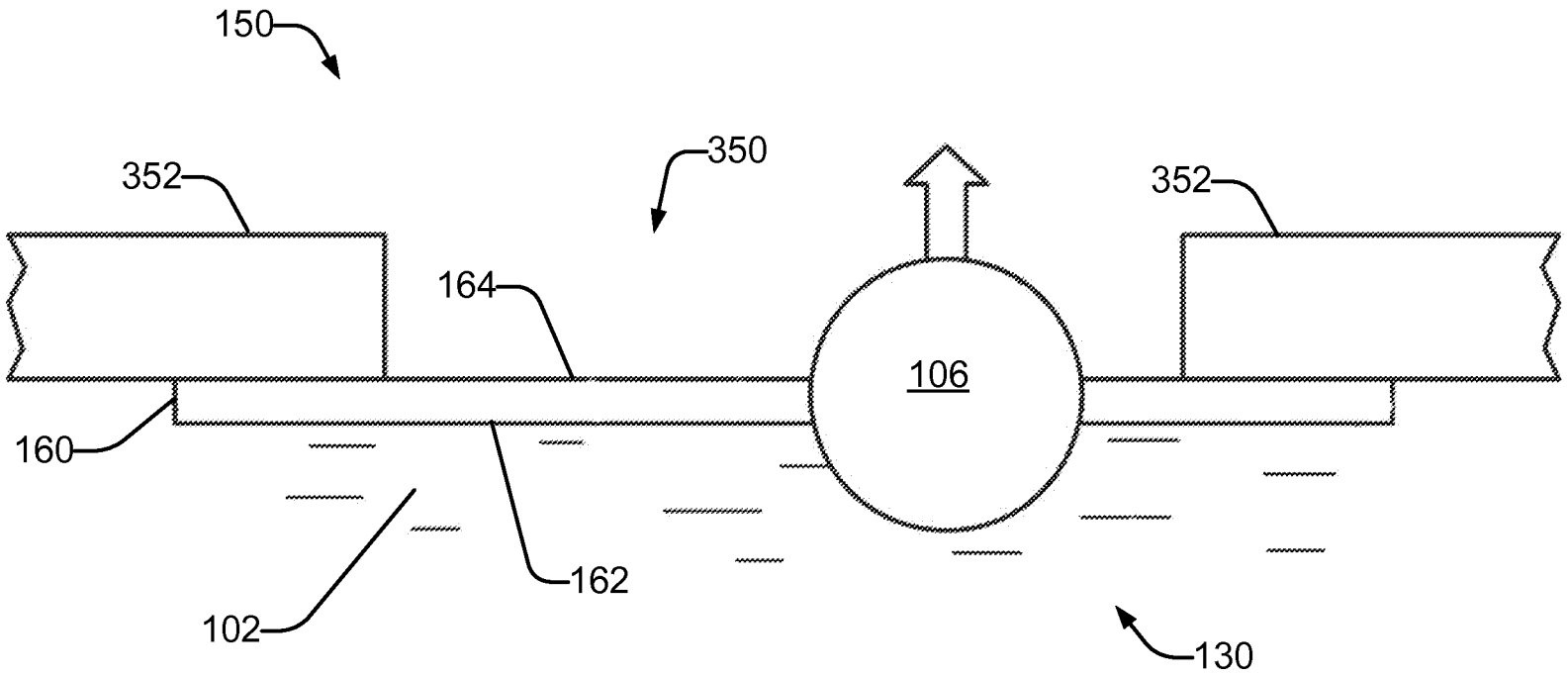
FIG. 3 is a schematic representation of pulling a gas bubble through a vent membrane usable with the system of FIG. 1 in accordance with an example of the present disclosure.

Considering now in further detail a vent of a fluid delivery system, and with further reference to FIG. 3, one example of the vent 150 has an opening 350, defined by walls 352, that is covered by the vent membrane 160. The wet side 162 of the vent membrane 160 faces the interior of the liquid enclosure 130, while the dry side 164 of the vent membrane 160 faces the interior of the vent 150. The vent membrane 160 is configured to pass gas bubbles 106 but not liquid 102 from the wet side 162 to the dry side 164 when a pressure $P_{WET}$ on the wet side 162 is greater than a pressure $P_{DRY}$ on the dry side 164. In some examples, the vent membrane 160 is further configured to block outside gas or air in the vent 150 from passing from the dry side 164 to the wet side 162 when $P_{DRY}>P_{WET}$, within an acceptable range of pressure differences across the membrane. In one example, the differential pressure between $P_{DRY}$ and $P_{WET}$ is maintained in a range of 8 to 80 inches of water to allow gas bubbles 106 to pass through the membrane 160 from the wet side 162 to the dry side 164. Such a differential pressure also prevents gas back-flow through the vent membrane 160 from the dry side 164 to the wet side 162.

In one example, the membrane 160 includes a first, liquid-philic part on the wet side 162 and a second, gas-permeable liquid-phobic part on the dry side 164. Each part may include multiple layers, or both parts may be integrated into a single structure. In some examples of a two-part construction, the liquid-philic part may be very thin and in close contact with the liquid-phobic part to achieve the desired functional characteristics.

In another example, the membrane 160 is an expanded PTFE (porous Teflon) membrane with characteristics selected based upon properties of the liquid 102 so as to be impermeable to the liquid 102. For instance, where the liquid 102 is water, which has a surface tension of 72 dyne/cm, an appropriate membrane 160 could have a water entry pressure of approximately 220 inches of water. Where the liquid 102 is an ink, which has a lower surface tension of about 30 to 40 dyne/cm, an appropriate membrane could have a water entry pressure of approximately 100 inches of water. For some liquids, the membrane 160 may have an "oleophobic" treatment to render it more liquid-phobic.

In various examples the vent 150 may be heat-staked in place, attached directly to a portion of the enclosure 130, molded into an insert that can be press-fit or otherwise attached to a portion of the enclosure 130, or disposed in the system in another manner.

In one example, the vent membrane 160 is disposed substantially horizontally. This maximizes the transfer surface area of the membrane 160 to the gas bubbles 106, which rise by buoyancy. In other examples, however, the vent membrane 160 may be disposed in other orientations. In one example, access to the vent 150 by the gas bubbles 106 is not restricted by conduits or similar features in the enclosure 130 which are so narrow as to prevent the bubble from contacting the vent membrane 160.

Figure 4:
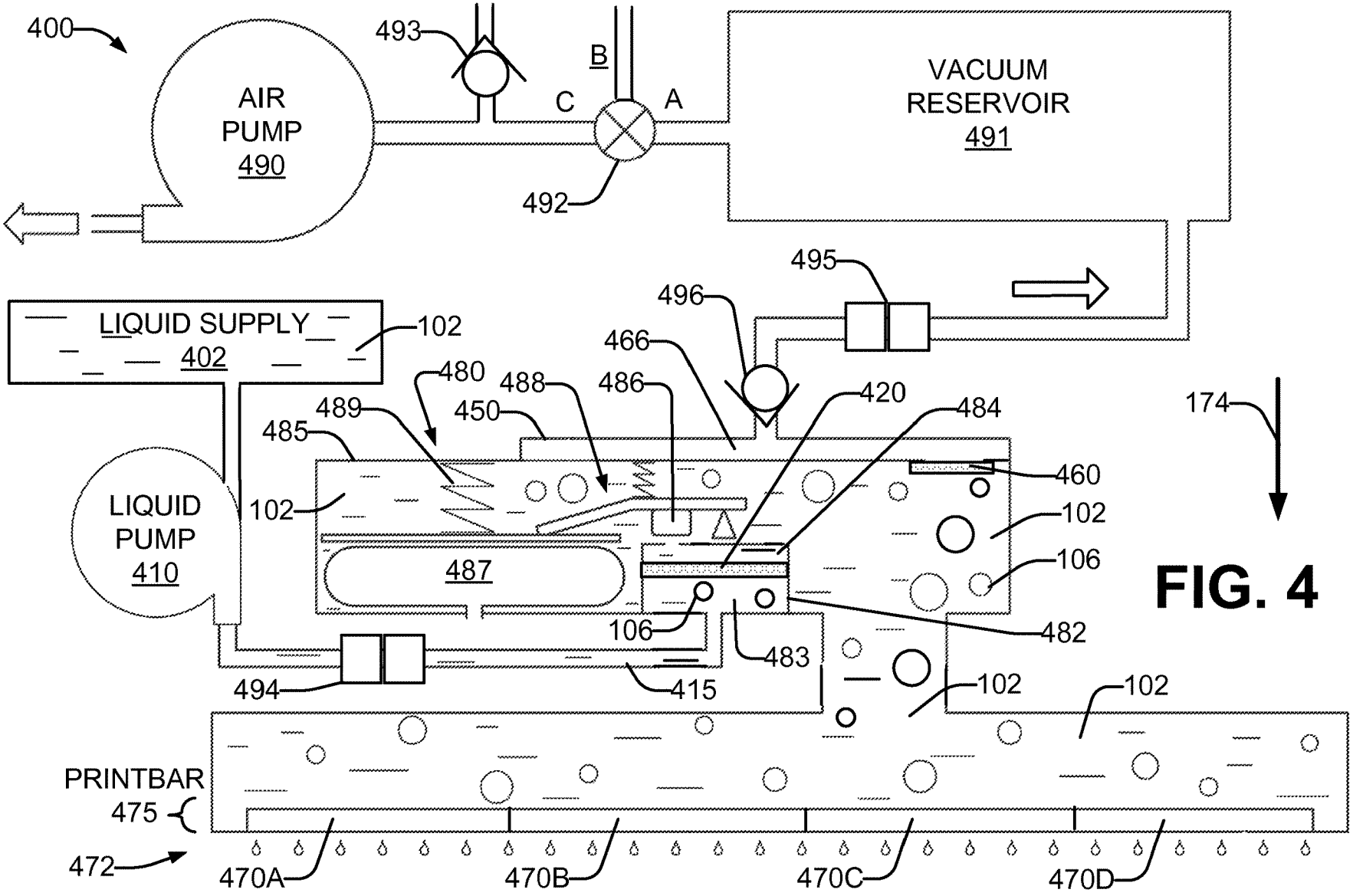
FIG. 4 is a schematic representation of a liquid delivery system for a page-wide printbar including multiple printheads in accordance with an example of the present disclosure.

Considering now another liquid delivery system, and with reference to FIG. 4, a liquid delivery system 400 includes a liquid pump 410, a conduit 415, a filter 420, a vent 450 having a vent membrane 460 to which a vacuum 466 is applied. The liquid pump 410, conduit 415, filter 420, vent 450, vent membrane 460, and each printhead 470A-D may the same as, or similar to, the corresponding liquid pump 110, conduit 115, filter 120, vent 150, and vent membrane 160 of FIG. 1. The liquid delivery system 400 delivers a liquid to one or more printheads through which drops 472 of the liquid 102 can be controllable ejected. In one example, the printhead may be a printbar 475 having plural printhead die 470A-D. The printhead die 470A-D may be arranged such that the printbar spans a printable width of a print medium (not shown) adjacent the printbar 475. In some examples, the printbar 475 is maintained in a stationary position during a printing operation of the printable width. Alternatively, the printhead die 470A-D may be considered to be multiple individual printheads. Each printhead die (or printhead) 470A-D may be the same as, or similar to, the printhead 170 of FIG. 1.

The liquid delivery system 400 includes a supply 402 of a liquid 102. The liquid 102 is pressurized by the liquid pump 410 and passes through the conduit 415 into an inlet chamber 482 of a pressure regulator 480. In one example, the liquid pump 410 is a diaphragm pump. The liquid pump 410 is capable of sufficiently pressuring the liquid 102 up to the bubble pressure or greater. The filter 420 divides the inlet chamber 482 into an upstream portion 483 and a downstream portion 484. The liquid 102 and gas bubbles 106 in the upstream portion 483 are pushed through the filter 420 to the downstream portion 484 of the inlet chamber 482 as described heretofore with reference to FIGS. 2A-2D.

The pressure regulator 480 regulates the pressure of the liquid 102 downstream of the regulator valve, in chamber 485. The flow of liquid 102 from the inlet chamber 482 into the output chamber 485 is controlled by a regulator valve 486. A bladder (or air bag) 487 expands and contracts to close and open the valve 486 through a linkage 488. The bladder 487 is open to the atmosphere, or connected to another suitable source of air pressure. A biasing spring 489 exerts a predetermined force on the bladder 487 to maintain the desired pressure in the output chamber 485, which is usually a slightly negative pressure relative to atmosphere in order to inhibit liquid drooling from the printbar 475 when no printing is being performed. In one example, the negative gage pressure is about 12 inches of water.

A gas (or air) management subsystem to remove gas bubbles 106 includes the vent 450 (and vent membrane 460) and an air pump 490 operatively coupled to the vent 450. The air pump 490 evacuates air from the dry side of the vent membrane 460 in order to lower the pressure so as to allow the gas bubbles 106 in the liquid 102 to pass through the vent membrane 460 but block the liquid 102 from doing so.

The vent 450 is connected to the air pump 490 through a vacuum reservoir 491 which is maintained at a desired range of lower pressures. the desired degree of vacuum in the vacuum reservoir 491 is set by turning on the air pump 490 and opening a solenoid valve 492 to connect ports A and C. When the desired degree of vacuum is achieved, the solenoid valve 492 is operated to disconnect port A from both ports B and C. As gas bubbles 106 move through the vent 450, the pressure in the vacuum reservoir 491 rises (i.e., the degree of vacuum declines). To compensate, the vacuum in the reservoir 491 is periodically refreshed by turning on the air pump 490 and opening a solenoid valve 492 to connect ports A and C until the desired degree of vacuum is achieved. The vacuum refresh duty cycle can be a function of print rate, temperature, gas solubility in the liquid, reservoir size, and/or other factors.

A vacuum pressure control valve 493 limits the degree of vacuum that can be achieved in the vacuum reservoir 491. If the vacuum increases beyond a setpoint of the vacuum pressure control valve 493, the valve opens to let in air from the atmosphere. In one example, the setpoint may be a gage pressure of about minus 50 inches of water.

Make-break fluid interconnections 494, 495 enable the printbar 475 to be disconnected from vacuum reservoir 491 and/or the liquid delivery system 400. This allows the printbar 475 to be transported or serviced and then reinstalled, or a replacement printbar 475 to be installed. The interconnection 494 is for the liquid, while the interconnection 495 is to the vacuum reservoir 491. A vacuum check valve 496 between the interconnection 495 and the vent 450 maintains the vacuum in the vent 450 of the disconnected printbar 475 and prevents outside air from entering the output chamber 485 through the vent membrane 460.

Figures 5A, 5B:
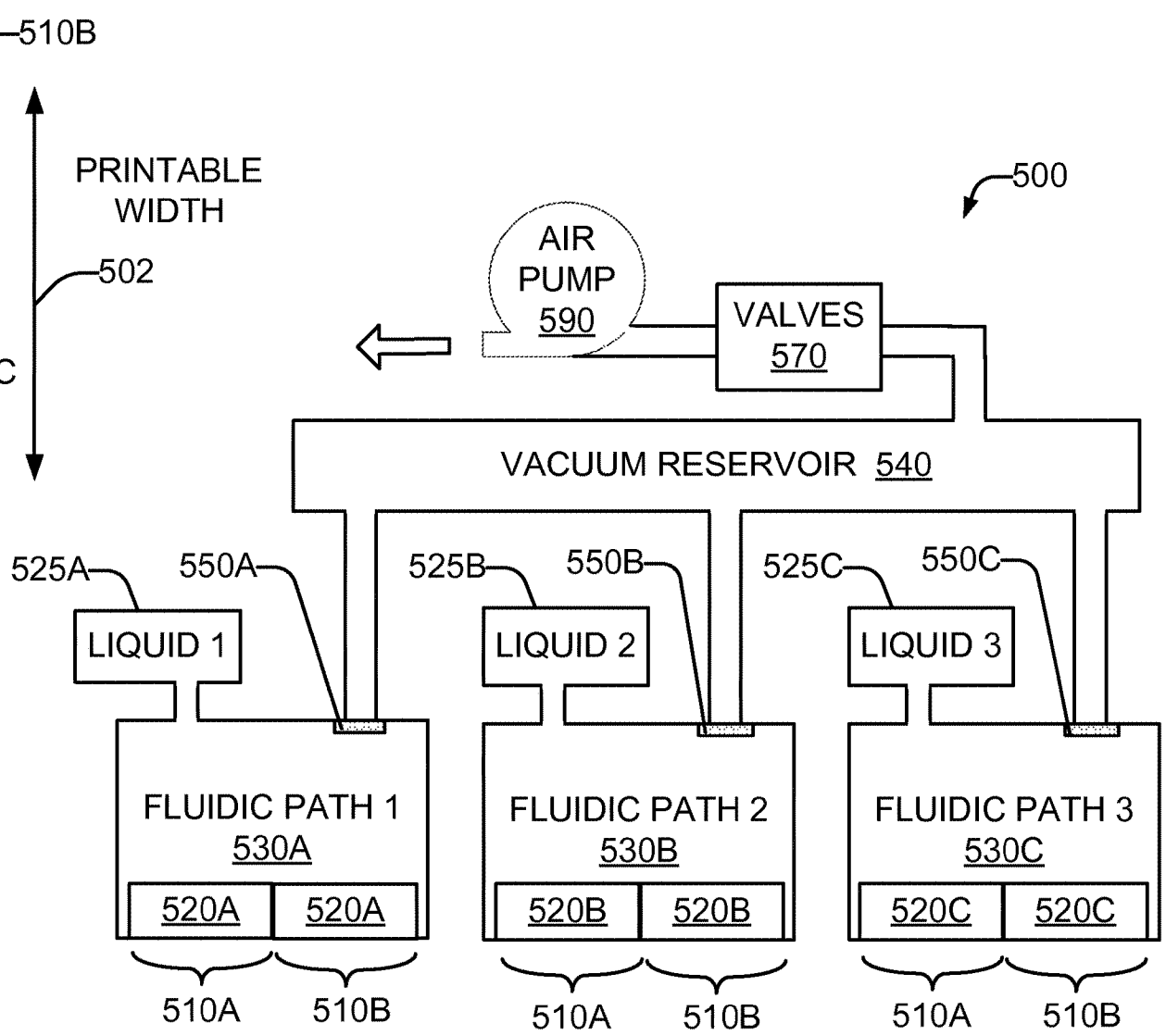
FIGS. 5A through 5B are schematic representations of a liquid delivery system for a multiple-liquid page-wide printbar including multiple printheads in accordance with an example of the present disclosure.

Considering now a liquid delivery system for a multiple-liquid page-wide printbar, and with reference to FIGS. 5A-5B, an example liquid delivery system 500 includes a printbar 504. The printbar 504 has an arrangement of liquid ejection elements (also called "drop ejectors" or "drop generators") for ejecting drops of the multiple liquids onto any position of a printable width 502 of a print medium (not shown) without moving the printbar 504 during a printing operation. The arrangement organizes the liquid ejection elements of the printbar 504 into sets (called "squads" 510) of printhead die slivers 520. A printhead die sliver 520 (also called a "printhead sliver", or just a "sliver") has a substantially linear array of liquid ejection elements for ejecting drops of a particular one of the liquids. A sliver squad 510 has plural slivers 520, each sliver 520 for ejecting drops of a different one of the liquids of the liquid delivery system 500. Within a squad 510, the plural slivers 520 are disposed in a substantially parallel arrangement. A number M of printhead squads 510 collectively span the printable width 502. The M squads 510 collectively form the printbar 504. The M squads 510 are maintained in a stationary position during a printing operation. In the example system 500, M=2: squad A 510A and squad B 510B. Each squad 510A, 510B has N slivers 520. In the example system 500, N=3: sliver 1 520A, sliver 2 520B, and sliver 3 520C. Each sliver 520A, 520B, 520C ejects or emits drops of a corresponding liquid 525A. 525B, 525C respectively. The liquid 525 may be different for each sliver 520. In some examples, each liquid is an ink of a different color.

The M squads 510 may be arranged in two staggered columns 505A, 505B such that the slivers 520 collectively span the printable width 502 for each liquid. Adjacent squads 510 may overlap in the direction of the printable width 502 such that the slivers 520 collectively can print all the liquids 525 on all the positions within the printable width.

The liquid delivery system 500 also includes N fluidic paths 530. The number N of fluidic paths 530 corresponds to the number N of different liquids and/or the number N of slivers 520 of ejection elements in the system 500. In the example system 500, N=3: fluidic path 1 530A, fluidic path 2 530B, and fluidic path 3 530C. Each fluidic path 530A, 530B, 530C is for a corresponding one of the different liquids 525A, 525B, 525C respectively.

Each fluidic path 530 includes a pump to provide the corresponding liquid 525 to a filter, and to push the liquid 525 and gas bubbles in the liquid 525 through the filter into an enclosure that is fluidically coupled to the corresponding arrays. Each fluidic path 530 also includes the sliver 520 for the corresponding liquid 525 in each of the squads 510. For example, fluidic path 2 530B is for liquid 525B and includes sliver 520B of squad A 510A and sliver 520B of squad B 510B.

Each fluidic path 530 also includes a vent 550 having a gas-permeable membrane. Path 530A includes vent 550A; path 530B includes vent 550B; and path 530C includes vent 550C. Each membrane includes a wet side and an opposing dry side. In various examples, each vent 550 may be the vent 150 (FIG. 1) or the vent 450 (FIG. 4), and the membrane may be the membrane 160 (FIG. 1) or the membrane 460 (FIG. 4). A vacuum applied to the dry side of the membrane pulls gas bubbles collected at the liquid side of the membrane through the membrane. In some examples, each fluidic path 530 may further include other elements of the liquid delivery system 100 (FIG. 1), such as for example the pump 110, conduit 115, filter 120, and enclosure 130. In some examples, each fluidic path 530 may further include other elements of the liquid delivery system 100 (FIG. 1) and/or liquid delivery system 400 (FIG. 4), such as for example the liquid pump 410; conduit 415; filter 420; regulator 480 including the inlet chamber 482, output chamber 485, valve 486, bladder 487 and/or other elements of the regulator 480; and/or fluid interconnections 494, 495.

The liquid delivery system 500 also includes a vacuum reservoir 540. The vacuum reservoir 540 is coupled to the vents 550 of the N fluidic paths 530 in order to continuously apply a vacuum to the dry side of the membrane of each fluidic path 530. In some examples, a single vacuum reservoir 540 couples to plural vents 550. In some examples, a single vacuum reservoir 540 couples to all the vents 550.

The liquid delivery system 500 also includes an air pump 590 coupled to the vacuum reservoir 540. The air pump 590 may be the air pump 490 (FIG. 4). A valve arrangement 570 may include the solenoid valve 492 (FIG. 4), vacuum pressure control valve 493, and/or vacuum check valve 496. While the valve arrangement 570 is illustrated in FIG. 5 as disposed between the air pump and the reservoir, in other examples some of all of the valve arrangement 570 may be disposed elsewhere in the liquid delivery system 500.

Figure 6:
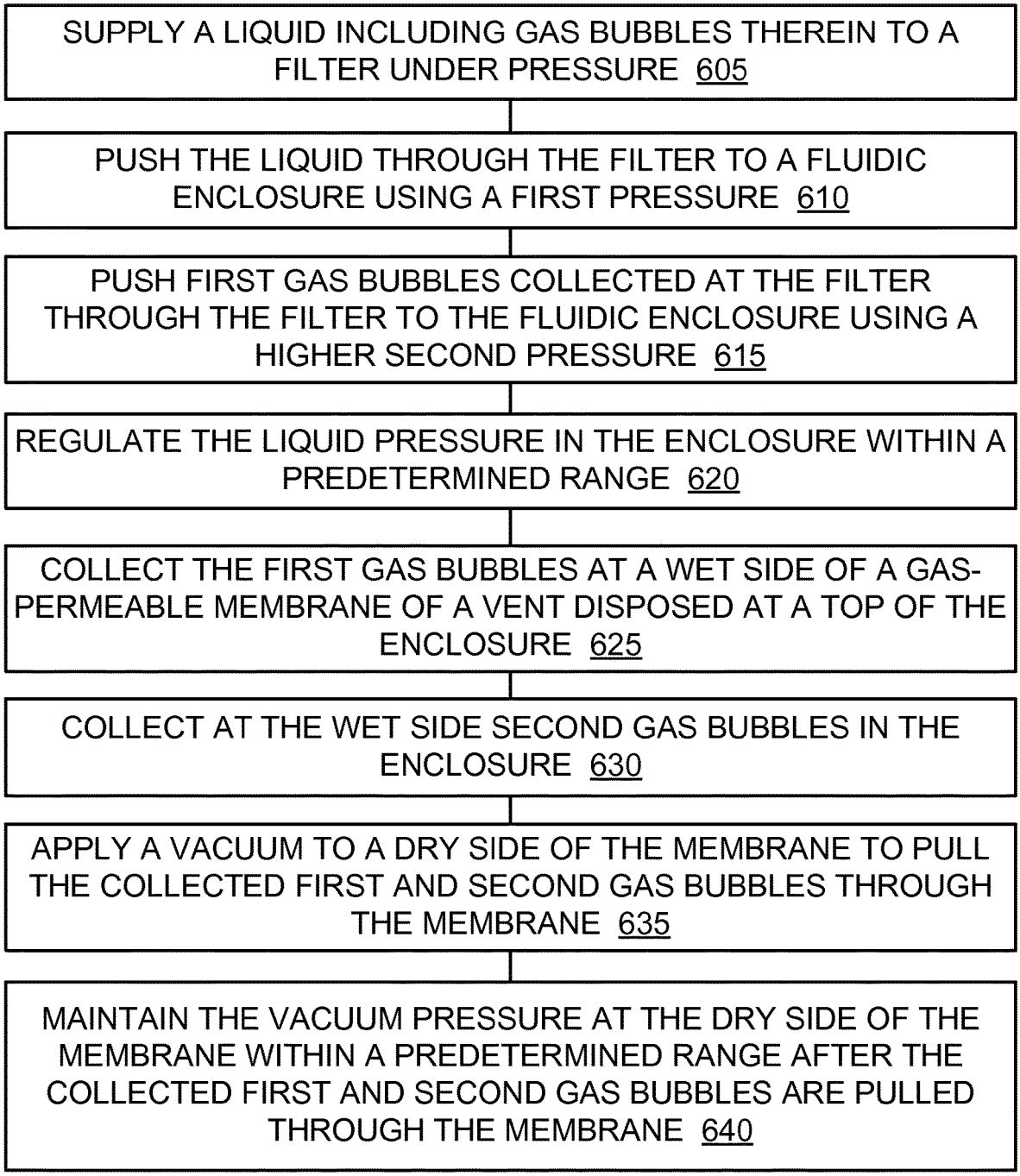
FIG. 6 is a flowchart in accordance with an example of the present disclosure of a method for delivering liquid to a printhead.

Considering now in further detail a method for delivering liquid to a printhead, and with reference to FIG. 6, a method 600 begins at 605 by supplying a liquid including gas bubbles therein to a filter under pressure. At 610, the liquid is pushed through the filter to a fluidic enclosure using a first pressure. At 615, a first set of gas bubbles collected at the filter are pushed through the filter to the enclosure using a higher second pressure (the bubble pressure). The first set of gas bubbles originate from upstream of the filter. At 620, the liquid pressure in the enclosure is regulated within a predetermined range. At 625, the first gas bubbles collect at a wet side of a gas-permeable membrane of a vent disposed at a top of the enclosure. At 630, a second set of gas bubbles collect at the wet side of the enclosure. The second set of gas bubbles originate from downstream of the filter. At 635, a vacuum is applied to a dry side of the membrane to pull the collected first and second gas bubbles through the membrane. At 640, the vacuum pressure at the dry side of the vent membrane is maintained within a predetermined range after the collected first From the foregoing it will be appreciated that the systems and methods provided by the present disclosure represent a significant advance in the art. Although several specific examples have been described and illustrated, the disclosure is not limited to the specific methods, forms, or arrangements of parts so described and illustrated. This description should be understood to include all novel and non-obvious combinations of elements described herein, and claims may be presented in this or a later application to any novel and non-obvious combination of these elements. The foregoing examples are illustrative, and different features or elements may be included in various combinations that may be claimed in this or a later application. Unless otherwise specified, operations of a method claim need not be performed in the order specified. Similarly, blocks in diagrams or numbers (such as (1), (2), etc.) should not be construed as operations that proceed in a particular order. Additional blocks/operations may be added, some blocks/operations removed, or the order of the blocks/operations altered and still be within the scope of the disclosed examples. Further, methods or operations discussed within different figures can be added to or exchanged with methods or operations in other figures. Further yet, specific numerical data values (such as specific quantities, numbers, categories, etc.) or other specific information should be interpreted as illustrative for discussing the examples. Such specific information is not provided to limit examples. The disclosure is not limited to the above-described implementations, but instead is defined by the appended claims in light of their full scope of equivalents. Where the claims recite "a" or "a first" element of the equivalent thereof, such claims should be understood to include incorporation of at least one such element, neither requiring nor excluding two or more such elements. Where the claims recite "having", the term should be understood to mean "comprising".

What is claimed is:

1. A liquid delivery and gas removal system for a printhead, comprising:

a pump to provide a liquid at a positive pressure;

a filter fluidically coupled to the pump to receive the pressurized liquid at an upstream side, at a first pressure push the liquid through the filter to a downstream side, and at a higher second pressure push gas bubbles in the liquid through the filter to the downstream side; and a vent having a gas-permeable membrane, a wet side of the membrane fluidically coupled to the downstream side and to a printhead, and a vacuum applied to a dry side of the membrane, wherein the vent is a sole vent in the system.

2. The system of claim 1, wherein the vacuum is continuously applied to the dry side of the membrane.

3. The system of claim 1, wherein the vent is positioned at an upper position on the downstream side such that the gas bubbles pushed through the filter and gas bubbles from the printhead collect at the wet side of the membrane and pass through the membrane.

4. The system of claim 1, wherein the downstream side of the filter and the printhead are fluidically coupled to a fluidic enclosure, the liquid delivery system further comprising:

a regulator fluidically coupled to the fluidic enclosure to regulate a pressure in the enclosure.

5. The system of claim 1, wherein the downstream side of the filter and the printhead are fluidically coupled to a fluidic enclosure, and wherein the vent membrane is disposed in a substantially horizontal position at an upper portion of the enclosure such that the gas bubbles on the downstream side collect at the wet side of the membrane.

6. The system of claim 1, comprising:

a vacuum reservoir coupled to the vent; and a vacuum check valve coupled between the vacuum reservoir and the vent to maintain the vacuum applied to the dry side of the membrane when the vacuum reservoir is disconnected.

7. The system of claim 1, comprising:

a vacuum reservoir coupled to the vent;

an air pump coupled to the vacuum reservoir; and a vacuum pressure control valve coupled to the air pump and the vacuum reservoir to limit the vacuum pressure at the dry side of the membrane.

8. The system of claim 7, comprising:

a solenoid valve coupled between the air pump and the vacuum reservoir, the valve opened periodically to connect the air pump to the vacuum reservoir to maintain the vacuum applied to the dry side of the membrane after the gas bubbles pass through the membrane into the vacuum reservoir.

9. A liquid delivery and gas removal system for a printbar, comprising:

M liquid ejection element squads collectively spanning a printable width of a medium while stationary, each squad having N linear printhead slivers of liquid ejection elements, each sliver for a different liquid;

N fluidic paths, each path for one of the different liquids and one of the N slivers in each squad, each path including a pump to provide liquid to a filter and to push the liquid and gas bubbles in the liquid through the filter into an enclosure fluidically coupled to the corresponding slivers, and a sole vent per fluidic path, the vent having a gas-permeable membrane including a wet side, in contact with the liquid, at an upper portion of the enclosure, a vacuum applied to an opposing dry side of the membrane to pull gas bubbles at the liquid side through the membrane.

10. The system of claim 9, wherein each of the different liquids is a different-color ink.

11. The system of claim 9, comprising:

a single vacuum reservoir coupled to the vents of the N fluidic paths to continuously apply the vacuum to the dry side of the membrane of each fluidic path.

12. A method for delivering liquid to a printhead, comprising:

supplying a liquid including gas bubbles therein to a filter under pressure;

pushing the liquid through the filter to a fluidic enclosure using a first pressure;

pushing first gas bubbles collected at the filter through the filter to the enclosure using a higher second pressure;

collecting the first gas bubbles at a wet side, in contact with the liquid, of a gas-permeable membrane of a vent disposed at a top of the enclosure;

collecting at the wet side second gas bubbles of the enclosure; and applying a vacuum to a dry side of the membrane to remove gas by pulling the collected first and second gas bubbles through the membrane, wherein the liquid is delivered to the printhead via a liquid delivery and gas removal system, and wherein the vent is the sole vent in the system.

13. The method of claim 12, wherein the second gas bubbles enter the enclosure from liquid ejection elements fluidically coupled to the fluidic enclosure.

14. The method of claim 12, comprising:

maintaining the vacuum pressure at the dry side of the vent membrane within a predetermined range after the collected first and second gas bubbles are pulled through the membrane.

15. The system of claim 1, wherein the gas bubbles collect at the upstream side of the filter causing the positive pressure to increase from the first pressure to the second pressure, and wherein the positive pressure decreases from the second pressure towards the first pressure after the collected gas bubbles are pushed through the filter to the downstream side by the second pressure.

* * * * *